United States Patent [19]

Spatafora et al.

[11] Patent Number: 5,024,046

[45] Date of Patent: Jun. 18, 1991

[54] METHOD AND DEVICE FOR WRAPPING CYLINDRICAL PRODUCTS

[75] Inventors: Mario Spatafora; Antonio Gamberini, both of Bologna, Italy

[73] Assignee: G. D Societa per Azioni, Bologna, Italy

[21] Appl. No.: 494,157

[22] Filed: Mar. 14, 1990

[30] Foreign Application Priority Data

Mar. 14, 1989 [IT] Italy ..... 3375 A/89

[51] Int. Cl.[5] ..... B65B 11/04

[52] U.S. Cl. ..... 53/466; 53/216; 53/234

[58] Field of Search ..... 53/465, 466, 211, 216, 53/234, 212, 225

[56] References Cited

U.S. PATENT DOCUMENTS

| | | | |
|---|---|---|---|
| 1,116,560 | 11/1914 | Buhse | 53/211 |
| 1,875,567 | 9/1932 | Daniels | 53/212 |
| 2,709,880 | 6/1955 | Jorgensen | 53/212 X |
| 3,659,394 | 5/1972 | Hartleib | 53/216 X |
| 3,899,865 | 8/1975 | Revaz | 53/225 X |

FOREIGN PATENT DOCUMENTS

| | | | |
|---|---|---|---|
| 745779 | 7/1980 | U.S.S.R. | 53/216 |
| 1386412 | 3/1975 | United Kingdom | 53/216 |

*Primary Examiner*—John Sipos

*Attorney, Agent, or Firm*—Marshall, O'Toole, Gerstein, Murray & Bicknell

[57] ABSTRACT

A method and device for wrapping cylindrical products whereby each product is fed, together with a portion of a respective portion of wrapping material, into a respective seat on a conveyor, and is fed by the conveyor into peripheral contact with a rolling surface by which it is turned about its axis and wrapped in the aforementioned portion of wrapping material; each seat being defined by idle rollers parallel to the axis of the product, and by mobile stop elements designed to cooperate laterally with the product for angularly locking the same inside the seat subsequent to rolling.

11 Claims, 2 Drawing Sheets

FIG. 1
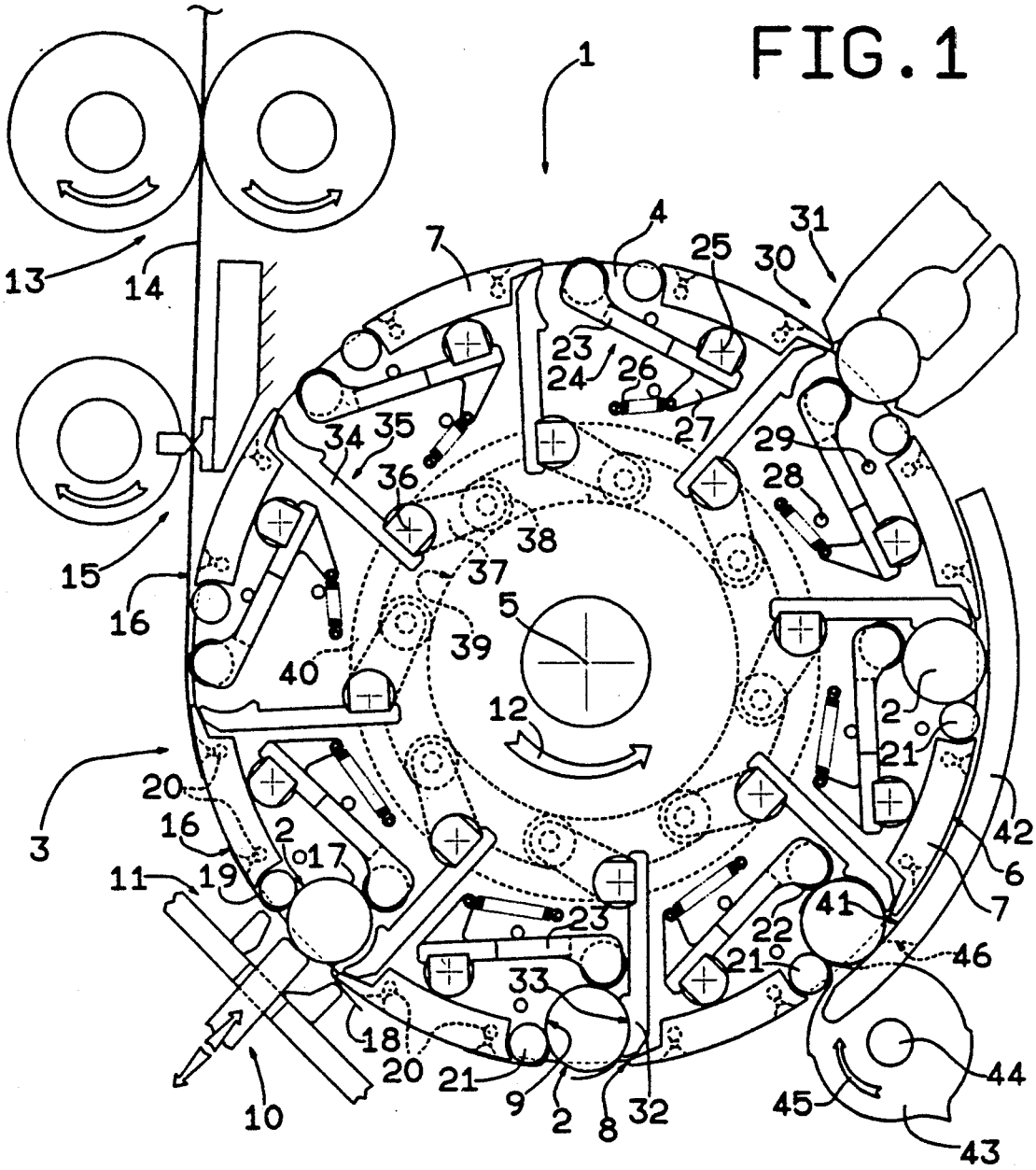
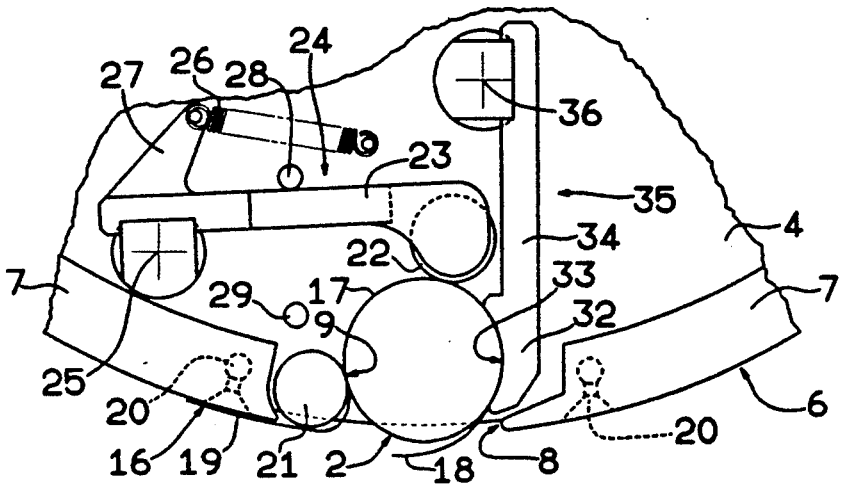
FIG. 2

FIG. 3
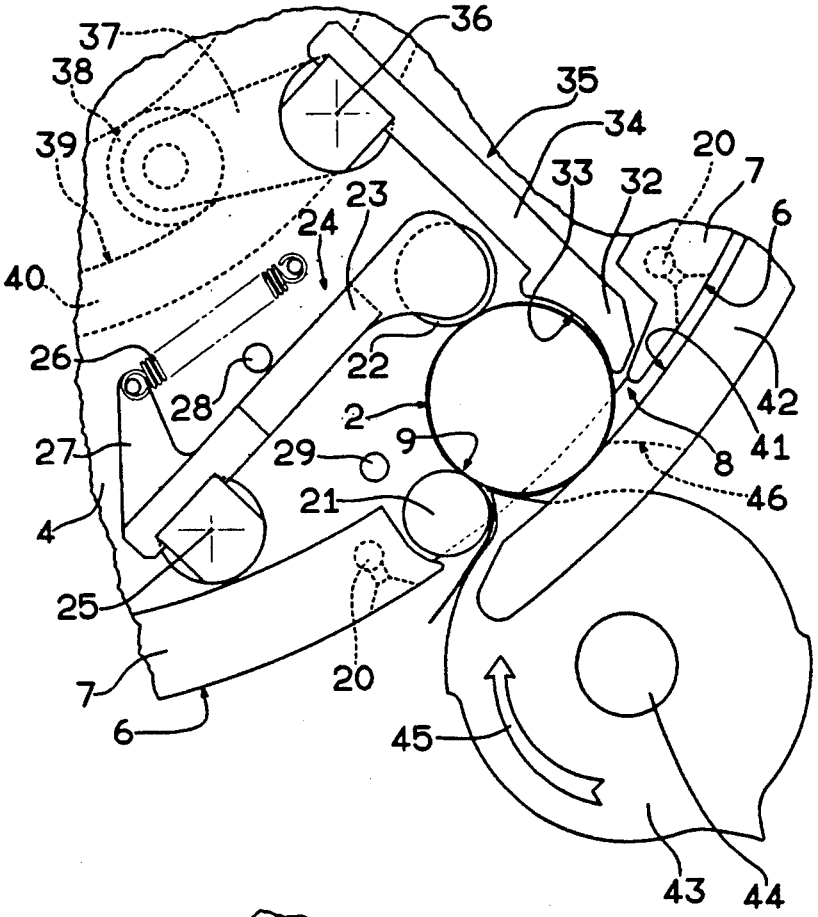
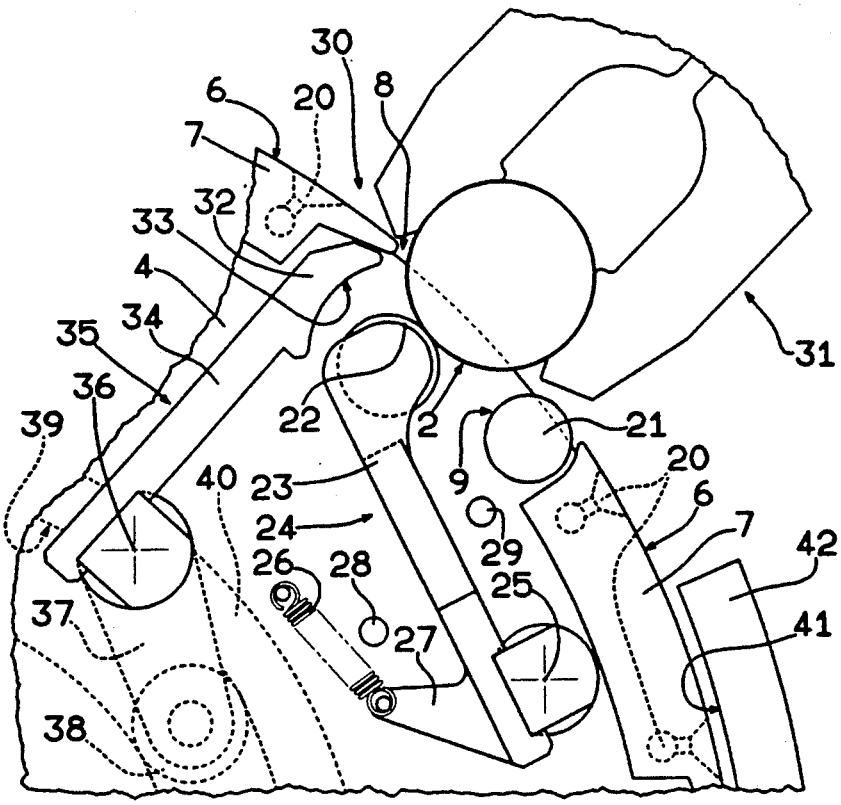
FIG. 4

METHOD AND DEVICE FOR WRAPPING CYLINDRICAL PRODUCTS

BACKGROUND OF THE INVENTION

The present invention relates to a method of wrapping cylindrical products.

In particular, the present invention relates to a method which may be used to advantage in the food industry for wrapping groups of cylindrical products, such as biscuits or sweets arranged side by side in such a manner as to form a cylindrical group.

Cylindrical-shaped products of the aforementioned type are known to be wrapped using a wrapping device usually comprising a conveyor consisting of a drum turning about is axis and having a number of substantially semicylindrical peripheral seats arranged parallel to the drum axis! Said drum is normally operated in conjunction with a first device for feeding portions of wrapping material, and a second device for feeding the products, which are inserted successively inside a respective said seat together with a respective portion of wrapping material.

Subsequent to insertion as described above, an intermediate portion of each portion of wrapping material is folded substantially in the form of a U between the surface of the seat and the outer surface of the product, and the two opposite end portions of the wrapping material projecting from the seat are folded by folding means into contact with the outer surface of the product, usually in such a manner as to partially overlap each other. Each seat (see, for example, British Patent Application No. 2.068.883) is usually provided with folding means comprising two mobile folding devices arranged on opposite sides of and travelling with the seat. By way of an alternative, simpler solution, the folding means of each seat comprise a single mobile folding device located upstream from the seat in the rotation direction of the drum, and which provides for folding into contact with the outer surface of the product the trailing end portion of wrapping material in relation to the travelling direction of the product, the leading end portion being folded by a single fixed folder located outwards of the outer periphery of the drum.

The above known wrapping device presents a number of drawbacks as a consequence of the folding devices assigned to each seat, which devices not only result in extremely complex and therefore high-cost, poorly reliable drum design, but also generally speaking, in poor grip between the folded end portions of wrapping material and the product. Moreover, as the vibration caused by the mobile peripheral masses consisting of the folding devices would be unacceptable at relatively high surface speeds, the speed of the products and respective seats must be kept relatively low.

SUMMARY OF THE INVENTION

The aim of the present invention is to provide a method of wrapping cylindrical products, designed to overcome the aforementioned drawbacks.

With this aim in view, according to the present invention, there is provided a method of wrapping cylindrical products, particularly groups of cylindrical sweets arranged side by side, characterised by the fact that it comprises stages consisting in:

successively feeding a conveyor with portions of wrapping material; said conveyor presenting a series of seats, each designed to receive a respective said product; each said seat being arranged crosswise in relation to the travelling direction of said conveyor, and having a lateral inlet; and each said portion of wrapping material being retained on said conveyor in such a position as to substantially close a respective said inlet;

successively feeding, inside each said seat at a loading station, an unwrapped product together with a portion of said respective portion of wrapping material; an inner surface of said seat being defined, at least partially, by rollers mounted in idle manner on said conveyor in such a manner that each turns about its axis perpendicular to said travelling direction; insertion of each said product inside a respective said seat causing a portion of said respective portion of wrapping material to fold in the form of a U about a portion of said product and in contact with said rollers;

feeding each said product forward until a peripheral portion of the same engages a rolling surface for rotating said product about its axis inside said seat and fully wrapping said portion of wrapping material about the same; and unloading said wrapped product from said seat at an unloading station.

The present invention also relates to a device implementing the above wrapping method.

According to the present invention, there is also provided a device for wrapping cylindrical products, particularly groups of cylindrical sweets arranged side by side, characterised by the fact that it comprises a conveyor having a series of seats, each designed to receive a respective said product, each arranged crosswise in relation to the travelling direction of said conveyor, and each having a lateral inlet; first means for successively feeding said products into respective said seats at a loading station; and second means, located upstream from said loading station in relation to said travelling direction, for successively feeding portions of wrapping material on to said conveyor in such a position that each substantially closes the inlet of a respective said seat; an inner surface of each said seat being defined, at least partially, by rollers mounted in idle manner on said conveyor in such a manner that each turns about its axis perpendicular to said travelling direction; provision being made for a rolling surface, located along said conveyor, downstream from said loading station, for successively cooperating with each said product and rotating the same about is axis inside said seat; and means being provided for unloading each wrapped product from its respective said seat at an unloading station.

BRIEF DESCRIPTION OF THE DRAWINGS

A non-limiting embodiment of the present invention will be described, by way of example, with reference to the accompanying drawings, in which:

FIG. 1 shows a schematic view of a preferred embodiment of the wrapping device according to the present invention;

FIGS. 2 to 4 show larger-scale views of respective details in FIG. 1.

DETAILED DESCRIPTION OF THE INVENTION

Number 1 in FIG. 1 indicates a device for wrapping cylindrical products 2 consisting, in the example shown, of groups of cylindrical sweets arranged side by side. Device 1 comprises a conveyor drum 3 consisting of a disc 4 revolving in steps about a central shaft 5 by virtue of a drive unit (not shown) and having, along its outer periphery, a cylindrical jacket 6 projecting from a surface of disc 4. Said jacket 6 is divided into a number of identical, equally-spaced segments 7 by a number of slots defining the inlets 8 of respective seats 9 carried o drum 3 and designed to receive respective products 2 fed successively on to drum 3 by a feed device 10 at a loading station 11.

Upstream from feed device 10, with reference to the travelling direction of drum 3 indicated by arrow 12, a further device 13 is provided for feeding a strip 14 of wrapping material, which strip 14 is cut by a cutting unit 15 into portions 16, which are fed successively on to the outer surface of jacket 6 in such a position that each substantially closes the inlet 8 of a respective seat 9. As shown in FIG. 1, each portion 16 is arranged with its intermediate portion 17 over respective inlet 8, and its front and rear portions 18 and 19 contacting the outer surface of jacket 6. Said front and rear portions 18 and 19 are maintained contacting jacket 6 by respective known suction devices 20 connected to a suction pump (not shown).

Each seat 9 is defined by a first roller 21 located at the rear end of respective inlet 8 and mounted in idle manner on disc 4 so as to turn about is axis perpendicular to arrow 12 and parallel to shaft 5. Each seat 9 is also defined by a second roller 22 mounted, in such a manner as to turn about an axis parallel to shaft 5, on to the end of a first arm 23 of a rocker arm 24 pivoting at point 25 on disc 4 so as to turn, in relation to the same, about an axis parallel to shaft 5 and against the the thrust exerted by a spring 26 located between disc 4 and the end of a second arm 27 of rocker arm 24. By virtue of spring 26, each roller 22 moves between a withdrawn position (FIG. 2), wherein arm 23 is arranged contacting a first stop element 28 on disc 4, and an extracted position, wherein arm 23 is arranged contacting a second stop element 29 on disc 4. As it moves between said withdrawn and extracted positions, roller 22 is designed to assume, as described in more detail later on, a first intermediate position (FIG. 3) close to said withdrawn position, and a second intermediate position (FIG. 4) close to said extracted position.

As shown in FIG. 1, roller 22 is moved elastically from the extracted to the withdrawn position by the insertion of product 2 inside seat 9 at loading station 11, and is reset to the extracted position for unloading product 2 from seat 9 a unloading station 30 located downstream from station 11 and comprising a known type of unloading grip 31.

Each seat 9 is also defined by a mobile guide and lock pad 32 having a cylindrical concave surface 33 designed to mate with the outer surface of product 2 housed inside seat 9 contacting both roller 21 and roller 22 in the withdrawn position. Pad 32 is connected integral with the end of a first arm 34 of a rocker arm 35 pivoting at point 36 on disc 4 so as to turn in relation to the same about an axis parallel with shaft 5. Rocker arm 35 comprises a second arm 37, the end of which is connected to a tappet 38 mating with a cam 39 formed on a fixed drum 40 coaxial with disc 4. As drum 3 rotates, cam 39 causes pad 32 to move, in relation to disc 4 and substantially parallel to arrow 12, between a withdrawn release position (FIG. 4) and a forward lock position (FIG. 2). Cam 39 is also designed to arrest pad 32 in an intermediate position (FIG. 3) close to said forward lock position.

Part of the outer surface of jacket 6 extending at any time between loading and unloading stations 11 and 30 is arranged facing the curved rolling surface 41 of a fixed curved plate 42. Upstream from said plate 42, provision is made for a folding roller element 43 fitted on to a drive shaft 44 parallel with shaft 5, so as to turn in the direction of arrow 45 and in the opposite direction to arrow 12, and successively engage and fold front portions 18 of portions 16 backwards into contact with the outer surface of respective products 2 as these engage said surface 41 of plate 42. For so doing, folding element 43 engages a respective axial slot 46 formed in the initial portion of plate 42.

In actual use, when a portion 16 of wrapping material is fed on to jacket 6 upstream from loading station 11 and in such a position as to close inlet 8 of a respective seat 9, rocker arm 24 of said seat 9 is set by respective spring 26 to the extracted position contacting stop element 29, and respective pad 32 is maintained in the withdrawn release position.

As already stated, upon insertion of product 2 inside seat 9 at loading station 11, intermediate portion 17 of portion 16 is inserted inside seat 9 and, at the same time, rocker arm 24 is moved by product 2 into the withdrawn position contacting stop element 28 and against the thrust exerted by spring 26. As soon as product 2 is inserted inside seat 9, pad 32 moves into the forward lock position to prevent product 2 from being expelled from seat 9 by spring 26 upon leaving loading station 11.

As shown in FIGS. 1 and 2, upon insertion of product 2 inside seat 9, rear portion 19 of portion 16, which is held on to jacket 6 by respective suction device 20, slides forward in the direction of arrow 12, whereas front portion 18, which is released from respective suction device 20, slides and is folded backwards (FIG. 2) substantially into contact with the outer surface of product 2.

As shown in FIG. 3, as product 2 is fed continuously beneath the initial portion of plate 42, front portion 18 is engaged by the outer periphery of folding element 43 by which it is pressed firmly backwards on to the outer surface of product 2. At the same time, cam 39 moves pad 32 from the forward lock position into an intermediate position extremely close to the forward lock position but sufficient to partially release product 2 and enable roller 22 to move, by virtue of spring 26, into its first intermediate position, wherein product 2 is positioned contacting surface 41 of plate 42. Subsequent to such contact, product 2 rolls about its axis in contact with surface 41, idle rollers 21 and 22 and folding element 43, the outer periphery of which is so designed as to guide and insert front portion 18 of portion 16 beneath roller 21.

Once product 2 has been fully rolled, after which portion 16 is arranged fully contacting the outer surface of product 2 with the end of rear portion 19 overlapping the end of front portion 18, cam 39 moves pad 32 back to the forward lock position. As a result, wrapped product 2 is backed up by surface 33 of pad 32 contacting the outer surface of the same, rocker arm 24 moves back to the withdrawn position contacting stop element 28, and product 2 is detached from surface 41, thus arresting the rolling function.

Product 2 is then fed forward by drum 3 to unloading station 30 at which point pad 32 is moved by cam 39 into the withdrawn release position, thus allowing roller 22 to move, by virtue of spring 26, into said second intermediate position wherein wrapped product 2 is partially expelled from seat 9 and gripped between the jaws of grip 31, displacement of which results in complete removal of product 2 from drum 3, and in the return of rocker arm 24 to the withdrawn position contacting stop element 29.

Unlike known wrapping devices, device 1 as described above thus provides for folding portions 16 about respective cylindrical products 2 using a single fixed rolling plate 42 and a single mobile folding element 43 detached from conveyor drum 3 and designed to cooperate successively with each of seats 9.

In connection with folding element 43, it should be pointed out that, for relatively high rotation speeds of drum 3, said element may be dispensed with and replaced, for example, by a compressed air emitting device mounted on plate 42.

We claim:

1. A method of wrapping cylindrical products (2), particularly groups of cylindrical sweet arranged side by side, characterised by the fact that it comprises stages consisting in:

successively feeding a conveyor (3) with portions of wrapping material (16); said conveyor (3) presenting a series of seats (9), each designed to receive a respective said product (2); each said seat (9) being arranged crosswise in relation to the travelling direction (12) of said conveyor (3), and having a lateral inlet (8); and each said portion of wrapping material (16) being retained on said conveyor in such a position as to substantially close a respective said inlet (8);

successively feeding, inside each said seat (9) at a loading station (11), an unwrapped product (2) together with a portion (17) of said respective portion of wrapping material (16); an inner surface of said seat (9) being defined, at least partially, by rollers (21, 22) mounted in idle manner on said conveyor (3) in such a manner that each turns about its axis perpendicular to said travelling direction (12); insertion of each said product (2) inside a respective said seat (9) causing a portion (17) of said respective portion of wrapping material (16) to fold in the form of a U about a portion of said product (2) and in contact with said rollers (21, 22);

feeding each said product (2) forward until a peripheral portion of the same engages a rolling surface (41) for rotating said product (2) about its axis inside said seat (9) and fully wrapping said portion of wrapping material (16) about the same;

unloading said wrapped product (2) from said seat (9) at an unloading station (30);

feeding each separated portion of wrapping material (16) onto said conveyor (3) so as to present an intermediate portion (17) facing the inlet (8) of the seat (9); and folding back, via external folding means (43), the from end portion (18) of the separated portion of wrapping material (16), and maintaining the fron end portion (18) in contact with the product (2) as the same engages the rolling surface (41).

2. A method of wrapping cylindrical products (2), particularly groups of cylindrical sweets arranged side-by-side, characterized by:

successively feeding a conveyor (3) with separated portions of wrapping material (16); the conveyor (3) presenting a series of seats (9), each seat being designed to receive a respective product (92); each seat (9) being arranged crosswise in relation to the traveling direction (12) of said conveyor (3) and having a lateral inlet (8); and each separated portion of wrapping material (16) being retained on said conveyor so as to substantially close a respective lateral inlet (8);

successively feeding by inserting, inside each seat (9) at a loading station (11), an unwrapped product (2) together with a portion (17) of said respective separated portion of wrapping material (16); an inner surface of said seat (9) being defined, at least partially, by idler rollers (21,22) mounted on the conveyor (3) so that each turns about its axis perpendicular to the conveyor traveling direction (12);

the insertion of each product (2) inside a respective seat (9) causing at least one (22) of the idler rollers (21,22) of each seat (9) mounted on a support (23) carried on the conveyor (3) to move from the respective inlet (8);

with the insertion of each said product (2) inside a respective seat (9) causing a portion (17) of said respective separated portion of wrapping material (16) to fold in the form of a U about a portion of the product (2) and into contact with said rollers (21,22);

feeding each product (2) forward until a peripheral portion of the same is opposite a rolling surface (41) and then moving the roller (22) towards the inlet (8) for bringing the periphery of the respective product (2) into contact with the rolling surface (41) for rotating the product (2) about its axis inside the seat (9) and fully wrapping the separated portion of wrapping material (16) about the product (2);

withdrawing the roller (22) from contact with the product to arrest the rolling function subsequent to axial rotation of the product (2) by a given angle; and unloading the wrapped product (2) from the seat (9) at an unloading station (30).

3. A method according to claim 2 in which the wrapped product (2) is expelled from the seat (9) by moving the roller (22) towards the respective inlet (8) at the unloading station.

4. A method according to claim 2 including:

maintaining a lock pad (32) in the seat (9) withdrawn from contact with the product (2) when the product is rotated and wrapped;

moving the lock pad (32) into contact with the wrapped product to lock it in the seat (9); and moving the wrapped product while locked in the seat by the lock pad (32) to an unloading station and then withdrawing the lock pad (32) from contact with the wrapped product to release the same and then unloading the wrapped product from the conveyor at the unloading station.

5. A method according to claim 4 including:

locating a cylindrical concave surface (33) of each pad (32), the concave surface (33) being designed to mate with the outer surface of the product (2), in a withdrawn position at the loading (11) and unloading (30) stations; and moving the concave surface (33) to an intermediate position for guiding and transversely retaining the product (2) in the seat, during rolling of the product.

6. A method of wrapping cylindrical products (2), particularly groups of cylindrical sweets arranged side-by-side, characterized by:

successively feeding a conveyor (3) with separated portions of wrapping material (16) so that each portion of wrapping material (16) is retained on the conveyor in such a position as to substantially close a respective lateral inlet (8);

the conveyor (3) presenting a series of seats (9) designed to receive a respective product (2); each seat (9) being arranged crosswise in relation to the traveling direction (12) of the conveyor (3) and having a lateral inlet (8); and each said seat (9) also containing a moveable lock pad (32);

successively feeding by inserting, inside each seat (9) with the pad (32) in a withdrawn nonlocking position at a loading station (11), an unwrapped product (2) together with a portion (17) of said respective separated portion of wrapping material (16); an inner surface of the seat (9) being defined, at least partially, by idler rollers (21,22) mounted on the conveyor (3) such that each turns about its axis perpendicular to the traveling direction (12); insertion of each product (2) inside a respective seat (9) causing a portion (17) of said respective separated portion of wrapping material (16) to fold in the form of a U about a portion of the product (2) and in contact with the rollers (21,22);

feeding each product (2) forward until a peripheral portion of the same engages a rolling surface (41) for rotating the product (2) about its axis inside the seat (9) and fully wrapping said portion of wrapping material (16) about the product to form a wrapped product while maintaining said lock pad (32) in its withdrawn non-locking position;

moving the lock pad (32) into a lock position with the pad firmly contacting the outer periphery of the wrapped product upon termination of the product rotation for locking said product (2) in a given angular position inside the seat (9);

moving the wrapped product to an unloading station and withdrawing the lock pad (32) from locking contact with the wrapped product; and unloading the wrapped product (2) from the seat (9) at an unloading station (30).

7. A device for wrapping cylindrical products (2), particularly groups of cylindrical sweets arranged side-by-side, characterized by the fact that it comprises a conveyor (3) having a series of seats (9), each designed to receive a respective said product (2), each arranged crosswise in relation to the traveling direction (12) of said conveyor (3), and each having a lateral inlet (8); first means (10) for successively feeding said products (2) into respective said seats (9) at a loading station (11); and second means (13), located upstream from said loading station (11) in relation to said traveling direction (12), for successively feeding portions of wrapping material (16) on to said conveyor (3) in such a position that each substantially closes the inlet (8) of a respective said seat (9); an inner surface of each said seat (9) being defined, at least partially, by idler rollers (21,22) mounted on the conveyor (3) so that each turns about its axis perpendicular to said traveling directing (12); at least one (22) of the rollers (21,22) of each said seat (9) being mounted on a support (23) carried by said conveyor (3) and movable in relation to the same to and from said respective inlet (8) and with the roller (22) mounted substantially transversely in relation to said traveling direction (12); a rolling surface (41), located along said conveyor (3), downstream from said loading station (11), for successively cooperating with each said product (2) so as to rotate the product about an axis inside said seat (9); means for moving said at least one roller (22) toward the inlet (8) for bringing the periphery of the respective product (2) into contact with the rolling surface (41); and means for unloading each wrapped product (2) from its respective seat (9) at an unloading station (30).

8. A device as claimed in claim 7, characterised by the fact that elastic means (26) are provided for moving each said support (23) towards said respective inlet (8).

9. A device as claimed in claim 7, characterised by the fact that said unloading means comprise an unloading element for each said seat (9 ); said unloading elements being designed to move with said conveyor (3) and each consisting of said mobile support (23) and respective said roller (22).

10. A device as claimed in claim 7, characterised by the fact that each said seat (9) is also defined by a mobile guide and lock pad (32) having a cylindrical concave surface (33) cooperating with the outer surface of said respective product (2); actuating means (38, 39) being provided for moving each said pad (32) substantially parallel to said travelling direction (12) and between a withdrawn release position, an intermediate position, for retaining and guiding said product (2), and a forward lock position.

11. A device as claimed in claim 7, characterised by the fact that it also comprises external folding means (43) for folding back the fron end portion (18) of each said portion of wrapping material (16).

* * * * *